US009466921B2

(12) United States Patent
Takane

(10) Patent No.: US 9,466,921 B2
(45) Date of Patent: Oct. 11, 2016

(54) LINEAR CONDUCTOR CONNECTION TERMINAL

(71) Applicant: IRISO ELECTRONICS CO., LTD., Kanagawa (JP)

(72) Inventor: Toru Takane, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 113 days.

(21) Appl. No.: 14/483,271

(22) Filed: Sep. 11, 2014

(65) Prior Publication Data

US 2015/0087193 A1 Mar. 26, 2015

(30) Foreign Application Priority Data

Sep. 25, 2013 (JP) ..... 2013-197782

(51) Int. Cl.

| | |
|---|---|
| ***H01R 11/22*** | (2006.01) |
| ***H01R 13/629*** | (2006.01) |
| ***H01R 12/51*** | (2011.01) |
| ***H01R 13/11*** | (2006.01) |
| *H01R 101/00* | (2006.01) |
| *H01R 4/48* | (2006.01) |

(52) U.S. Cl.

CPC ..... *H01R 13/629* (2013.01); *H01R 12/515* (2013.01); *H01R 13/11* (2013.01); *H01R 4/4836* (2013.01); *H01R 2101/00* (2013.01)

(58) Field of Classification Search

CPC ..... H01R 13/113; H01R 101/00
USPC ..... 439/852, 872, 882
See application file for complete search history.

(56) References Cited

U.S. PATENT DOCUMENTS

| | | | | |
|---|---|---|---|---|
| 3,363,224 | A * | 1/1968 | Gluntz | H01R 13/11 439/852 |
| 2013/0029529 | A1 | 1/2013 | Osagie et al. | |

FOREIGN PATENT DOCUMENTS

| | | | |
|---|---|---|---|
| CN | 102832465 | A | 12/2012 |
| DE | 102004059017 | A1 | 6/2006 |
| JP | 50-36089 | U | 4/1975 |
| JP | 6-68914 | A | 3/1994 |
| JP | 6-60964 | U | 8/1994 |
| JP | 10-12294 | A | 1/1998 |
| JP | 10-340745 | A | 12/1998 |
| JP | 3069754 | U | 4/2000 |
| JP | 2001-332317 | A | 11/2001 |
| JP | 2011-76831 | A | 4/2011 |
| JP | 2011-159607 | A | 8/2011 |
| WO | WO2010/146525 | A1 | 12/2010 |

OTHER PUBLICATIONS

European Search Report for European Patent App. No. 14184756.6 (Jan. 22, 2015).

* cited by examiner

*Primary Examiner* — Phuongchi T Nguyen
(74) *Attorney, Agent, or Firm* — Cermak Nakajima & McGowan LLP; Tomoko Nakajima

(57) ABSTRACT

A housing of a linear conductor connection terminal is provided with a first contact point portion having a recessed portion composed of a metal plate and opening inwardly of the housing. The recessed portion allows insertion of a linear conductor inserted into the housing from an insertion port. The housing is further provided with a second contact point portion that supports contact between the linear conductor and the first contact point portion. This allows the linear conductor to reliably conductively contact the first contact point portion and the second contact point portion.

19 Claims, 7 Drawing Sheets

LINEAR CONDUCTOR CONNECTION TERMINAL

BACKGROUND OF THE INVENTION

1. Field of the Invention

The present invention relates to a linear conductor connection terminal that conductively connects between a substrate and a linear conductor such as a cable, for example.

2. Description of the Related Art

There has hitherto been used a linear conductor connection terminal having a housing, an insertion port for insertion of a linear conductor into the housing, and a terminal that conductively connects with the linear conductor as a linear conductor connection terminal that conductively connects between a substrate and a linear conductor such as a cable. In some linear conductor connection terminals, a groove configured to hold the linear conductor is provided in the terminal, and a contact point portion is provided on the same terminal and on the back side away from the groove (see Japanese Unexamined Patent Application Publication No. 2001-332317, for example). In the linear conductor connection terminal, the linear conductor passes inside the groove provided in the terminal to be held between a support force relaxation lever and the terminal to achieve strong conductive connection between the linear conductor and the terminal.

However, the linear conductor connection terminal used for light emitting diode (LED) illumination, for example, is significantly small, and it may be difficult for an operator to manually connect a thin linear conductor to the linear conductor connection terminal. Specifically, when the linear conductor is inserted from the insertion port deep into the housing, the linear conductor may be inserted in a direction that is different from the direction of the contact point portion. In this case, even if it is attempted to guide the linear conductor to the contact point portion using the groove, the linear conductor may not reach the contact point portion unless the linear conductor is inserted straight toward the contact point portion since the contact point portion is provided on the back side away from the groove.

SUMMARY OF THE INVENTION

The present invention has been made to address the foregoing issue. That is, it is desirable to provide a linear conductor connection terminal that allows a linear conductor such as a cable to reliably reach a contact point portion.

In order to address the foregoing issue, the present invention is configured as follows.

That is, it is desirable to provide a linear conductor connection terminal including a housing having an insertion port for a linear conductor and fixed to a substrate, in which the housing has a first contact point portion having a recessed portion composed of a metal plate and opening inwardly of the housing, the first contact point portion allowing insertion of the linear conductor inserted from the insertion port into the housing through the recessed portion, and a second contact point portion that contacts the linear conductor inserted through the recessed portion to support contact between the linear conductor and the first contact point portion.

With the housing having a recessed portion composed of a metal plate and opening inwardly of the housing, the linear conductor inserted into the housing from the insertion port can be inserted through the recessed portion, and guided to the back side of the housing along the center axis of the linear conductor. Hence, even a linear conductor that is thin and easily bendable, for example, can be reliably inserted deep into the housing through the recessed portion. With the first contact point portion having such a recessed portion, in addition, the first contact point portion and the linear conductor can be reliably conductively connected to each other with the linear conductor kept inside the recessed portion not to move away from the first contact point portion.

In addition, the housing includes a second contact point portion that contacts the linear conductor inserted through the recessed portion to support contact between the linear conductor and the first contact point portion. Hence, the linear conductor can be reliably conductively connected to the linear conductor connection terminal without slipping away from the recessed portion.

In the present invention, the first contact point portion may be formed by bending a part of the metal plate forming the housing into a recessed shape. If the first contact point portion is formed by bending a part of the metal plate forming the housing into a recessed shape, the number of parts can be reduced.

In the present invention, the first contact point portion and the second contact point portion may be formed as a part of the metal plate forming a top surface portion of the housing and a part of the metal plate forming a bottom surface portion of the housing. This reduces the number of parts compared to a case where the first contact point portion and the second contact point portion are provided separately from the top surface portion and the bottom surface portion of the housing.

In the present invention, the first contact point portion may have a coupling portion that has spring elasticity and that connects between the recessed portion and the housing in a cantilever manner along the insertion direction, and the coupling portion may be formed as a part of the metal plate that is integral with the housing and the recessed portion. This allows the recessed portion to reliably elastically contact the linear conductor because of the spring elasticity of the coupling portion. If the coupling portion is formed as a part of the metal plate that is integral with the housing and the recessed portion, in addition, the number of parts can be reduced compared to a case where the coupling portion is formed separately from the housing and the recessed portion.

In the present invention, the first contact point portion may be formed on one surface of the housing, and formed to be inclined toward an inside of the housing from one end side, from which the linear conductor is inserted, to the other end. This allows the linear conductor to be guided into the housing along the inclination of the first contact point portion to be correctly connected to the second contact point portion even if the linear conductor inserted into the housing from the insertion port is directed outwardly of the housing and closer to the one surface on which the first contact point portion is provided.

In the present invention, the first contact point portion and the second contact point portion may be provided opposite to each other across a center axis of the linear conductor inserted into the housing, and formed to be inclined closer to the center axis from a side from which the linear conductor is inserted. This allows an insertion passage for the linear conductor to be tapered by the facing inclination surfaces. Therefore, the inclination surfaces can guide the distal end of the linear conductor to the back side of the housing so that the linear conductor is reliably inserted straight.

In the present invention, the first contact point portion and the second contact point portion may be each formed as an elastic piece that abuts with the linear conductor inserted into the housing to be elastically displaced. This allows the linear conductor to be reliably held by the spring elasticity of the first contact point portion and the second contact point portion.

In the present invention, the recessed portion may have a horizontal wall portion having a contact point edge portion formed by a corner portion of the metal plate that contacts the linear conductor, and a vertical wall portion provided at a side end of the horizontal wall portion to extend along an insertion direction of the linear conductor, the horizontal wall portion and the vertical wall portion may guide the linear conductor inserted from the insertion port to a back side inside the housing, and the contact point edge portion formed by the corner portion of the metal plate may be engaged with the linear conductor to contact the linear conductor.

With the recessed portion having a horizontal wall portion, movement of the linear conductor toward the horizontal wall portion can be regulated with the linear conductor caused to extend along the horizontal wall portion, for example. This allows the linear conductor to be smoothly guided to the back side inside the housing. If the recessed portion also has a vertical wall portion provided along the insertion direction of the linear conductor, in addition, the linear conductor can be caused to extend also along the vertical wall portion. In this way, movement of the linear conductor in directions other than the insertion direction can also be regulated. With the recessed portion having wall portions extending along at least two different directions, it is easy to regulate movement of the linear conductor in an unexpected direction, and the linear conductor can be reliably guided to the back side inside the housing.

In the present invention, the housing may include a lever that displaces at least one of the first contact point portion and the second contact point portion in a direction away from the linear conductor. Operating the lever allows the linear conductor to move away from the first contact point portion or the second contact point portion, which allows the linear conductor to be easily extracted from the linear conductor connection terminal.

In the present invention, the lever may be formed by bending a part of the metal plate forming the housing. If the lever is formed by bending the metal plate, a lever in the shape of a plate spring that is elastically displaceable, for example, can be obtained to facilitate an operation to hold and release the linear conductor. In addition, the number of parts can be reduced by forming the lever and a part of the housing integrally with each other.

In the present invention, the lever may have an operation portion with a width that is larger than an outside diameter of the linear conductor inserted into the housing. This allows the operation portion to protrude from an end side of the linear conductor in the width direction even if the lever and the linear conductor partially overlap each other, for example. Therefore, the lever can be operated at the protruding portion.

In the present invention, at least one of the first contact point portion and the second contact point portion may be formed as an elastic piece by cutting and raising a part of the metal plate forming the lever. This allows at least one of the first contact point portion and the second contact point portion to be easily displaced in a direction away from the linear conductor in conjunction with the lever. With at least one of the first contact point portion and the second contact point portion formed as an elastic piece, in addition, the contact point portion can be caused to elastically contact the linear conductor inserted into the housing.

In the present invention, the first contact point portion may have a contact point edge portion formed by a corner portion of the metal plate that contacts the linear conductor. This allows the contact point edge portion to contact the linear conductor inserted into the housing, for example. Therefore, the first contact point portion can be engaged with the linear conductor to contact the linear conductor, which enhances the force for holding the linear conductor. With the contact point edge portion retaining the linear conductor, in addition, easy extraction of the linear conductor can be suppressed even if a force in the extraction direction is applied to the linear conductor.

In the present invention, the second contact point portion may have a contact point edge portion formed by a corner portion of a metal plate that contacts the linear conductor. This allows the contact point edge portion to contact the linear conductor inserted into the housing, for example. Therefore, the second contact point portion can be engaged with the linear conductor to contact the linear conductor, which enhances the force for holding the linear conductor. With the contact point edge portion retaining the linear conductor, in addition, easy extraction of the linear conductor can be suppressed even if a force in the extraction direction is applied to the linear conductor.

In the present invention, the first contact point portion may have a contact point edge portion formed by a corner portion of the metal plate that contacts the linear conductor, the second contact point portion may have a contact point edge portion formed by a corner portion of a metal plate that contacts the linear conductor, and the contact point edge portion of the first contact point portion and the contact point edge portion of the second contact point portion may be engaged with the linear conductor to contact the linear conductor. This allows the linear conductor to be reliably held, and to stably conductively contact the first contact point portion and the second contact point portion.

In the present invention, the first contact point portion and the second contact point portion may have respective contact point edge portions, and the respective contact point edge portions may be disposed opposite to each other to hold the linear conductor therebetween. This allows the linear conductor to be reliably held. Because the linear conductor is reliably retained when a force in the extraction direction is applied, in addition, the linear conductor is not easily extracted from the first contact point portion and the second contact point portion.

In the present invention, the linear conductor may have an electrically insulating sheath, in which case the insertion port may be formed with such a size that allows insertion of the linear conductor but that does not allow insertion of the sheath. Thus, even if the linear conductor has an electrically conductive sheath, the sheath can be prevented from being inserted through the inside of the linear conductor connection terminal. Hence, contact of the sheath with the first contact point portion or the second contact point portion can be suppressed, and the linear conductor and the linear conductor connection terminal can be reliably conductively connected to each other.

In the present invention, the housing may have a top surface portion and a bottom surface portion, the top surface portion may be at the same height as or proximate in height to an upper end of the sheath of the linear conductor, and the bottom surface portion may be at the same height as or proximate in height to a lower end of the sheath. If the top surface portion is at the same height as or proximate in height to an upper end of the sheath of the linear conductor, the profile of the entire linear conductor connection terminal can be reduced, and it is unlikely that the linear conductor connection terminal projects compared to other parts mounted on a substrate. If the bottom surface portion is at the same height as or proximate in height to a lower end of the sheath, in addition, the linear conductor and the substrate can be easily spaced from each other.

According to the present invention, a linear conductor connection terminal that allows a linear conductor such as a cable to reliably reach a contact point portion can be obtained. In addition, a linear conductor connection terminal that allows conductive connection with a linear conductor to be easily maintained can be obtained.

DESCRIPTION OF THE PREFERRED EMBODIMENTS

A linear conductor connection terminal 1 will be described below with reference to the drawings. The linear conductor connection terminal 1 is mounted on a substrate 3 on which an LED is provided and which is provided in an LED bulb, for example. The linear conductor connection terminal 1 is used to connect the substrate 3 to a circuit substrate (not illustrated) including a lighting device configured to light the LED via a cable 2.

Embodiment

FIGS. 1 to 11

Figure 1:
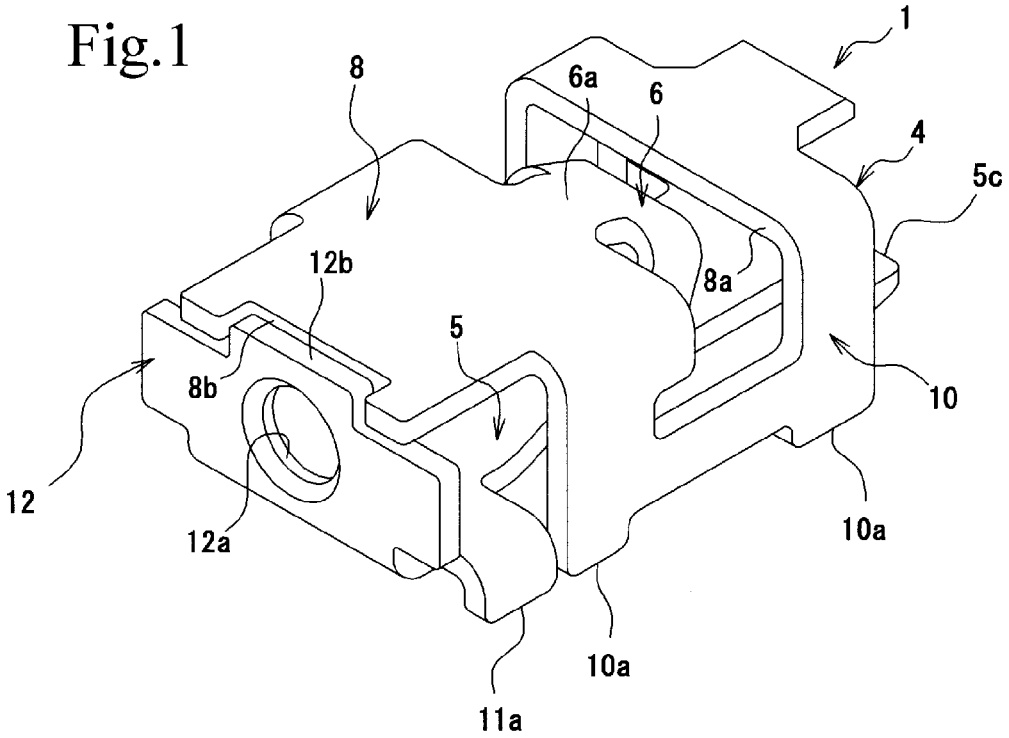
FIG. 1 is a perspective view of a linear conductor connection terminal according to an embodiment of the present invention.
Figure 2:
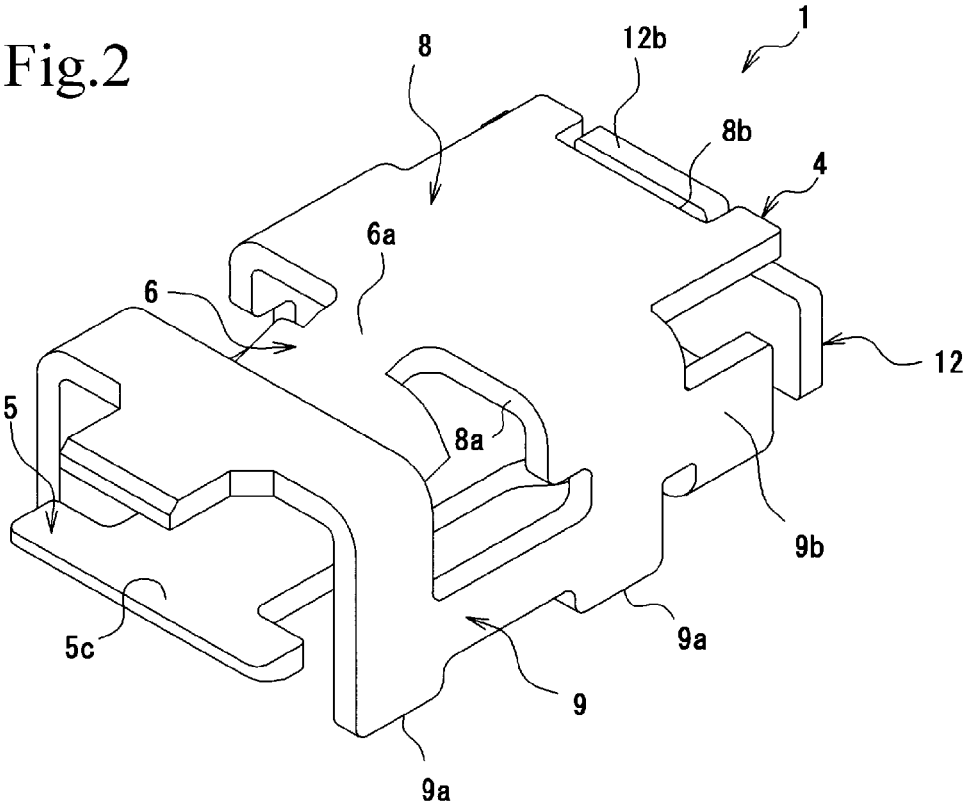
FIG. 2 is a perspective view of the linear conductor connection terminal of FIG. 1 illustrated from the lever side.

The linear conductor connection terminal 1 according to the embodiment is a metal terminal that conductively connects between the cable 2 and the substrate 3. The cable 2 includes a linear conductor 2*a* and an electrically insulating sheath 2*b*, for example. As illustrated in FIGS. 1 and 2, the linear conductor connection terminal 1 includes a housing 4, a lever 5, a first contact point portion 6, and a second contact point portion 7. The linear conductor connection terminal 1 is formed integrally by bending a conductive metal plate formed by punching.

(Housing)

As illustrated in FIGS. 1 to 8, the housing 4 is a generally rectangular parallelepiped having a housing space 4*a* for the linear conductor 2*a* inside. The housing 4 has a top surface portion 8, a left side surface portion 9, a right side surface portion 10, a bottom surface portion 11, and a front surface portion 12. The back side of the housing 4 which is opposite to the front surface portion 12 is open with no plate surface provided.

The height of the housing 4 from the substrate 3 is 1.8 mm. The respective lengths of the housing 4 in the short direction and the longitudinal direction are 2.9 mm and 5 mm, respectively. The housing 4 is mainly used for the cable 2 with a diameter including the sheath 2*b* of 1.5 mm.

Figure 7:
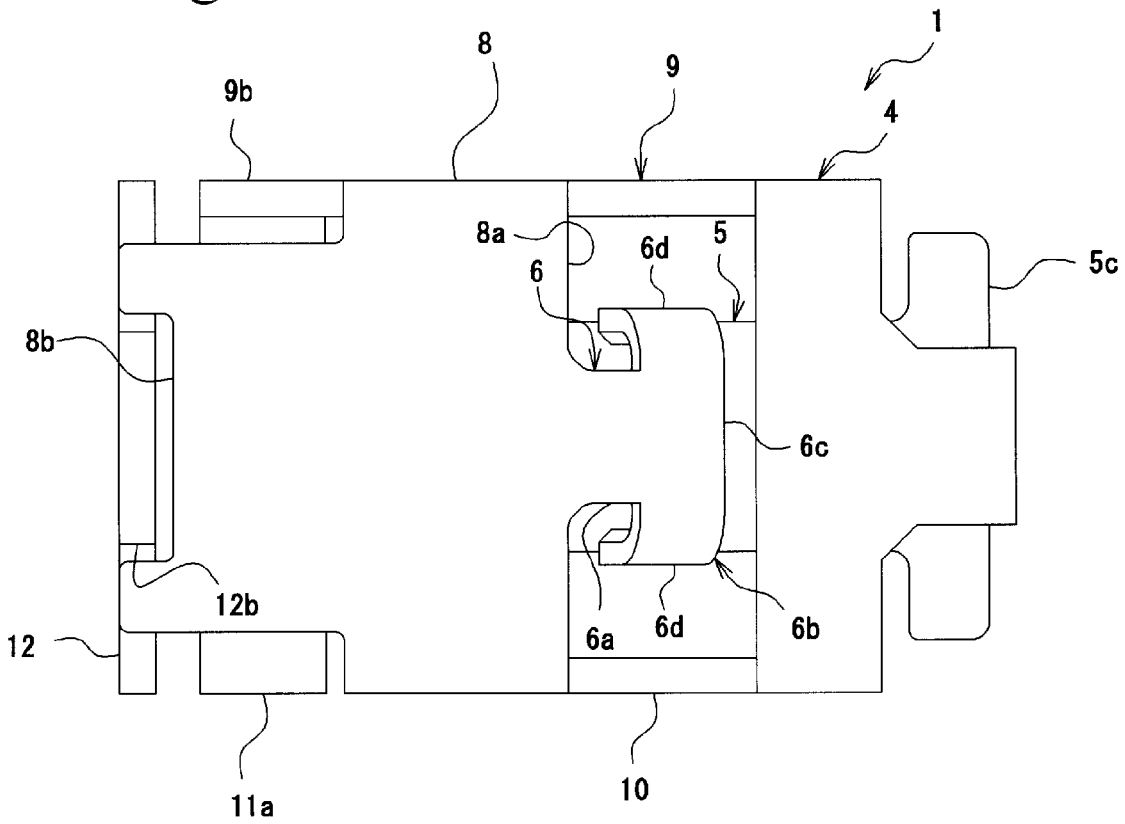
FIG. 7 is a plan view of the linear conductor connection terminal of FIG. 1.

The top surface portion 8 is a plate surface extending in parallel with the substrate 3. As illustrated in FIG. 7, the first contact point portion 6 is formed to hang down generally from the center of the top surface portion 8. A plating hole 8*a* that faces the top surface portion 8, the left side surface portion 9, and the right side surface portion 10 is provided around the first contact point portion 6. The plating hole 8*a* facilitates entry of a plating liquid into the housing when plating the linear conductor connection terminal 1. In addition, a recessed portion 8*b* is provided at the upper end portion of the top surface portion 8 on the front surface portion 12 side.

Figure 5:
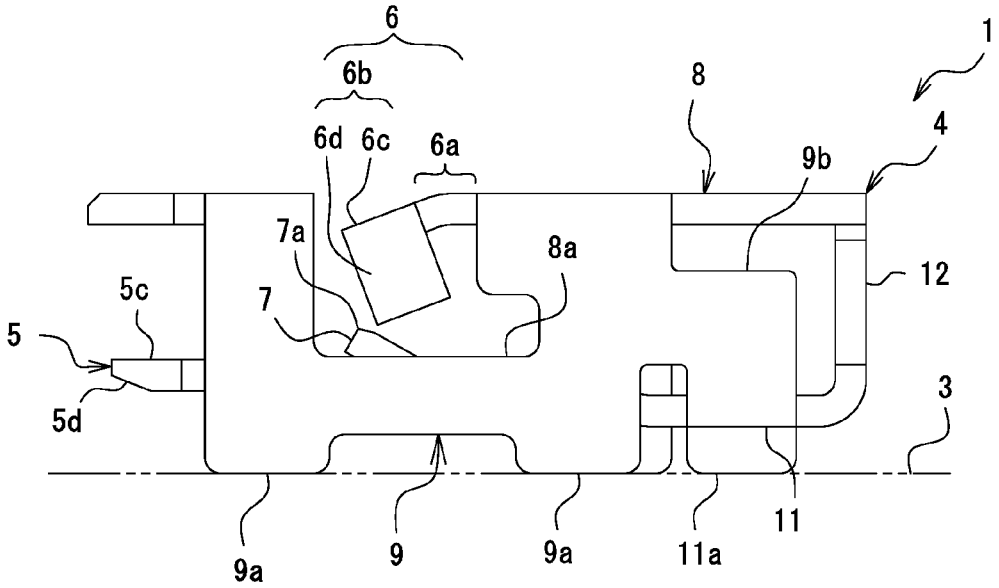
FIG. 5 is a left side view of the linear conductor connection terminal of FIG. 1.
Figure 6:
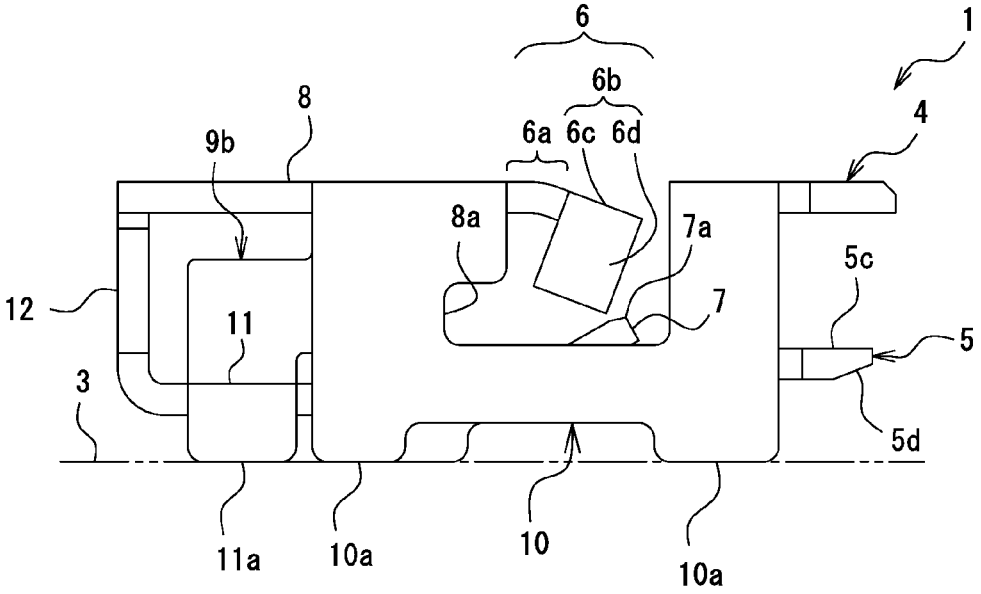
FIG. 6 is a right side view of the linear conductor connection terminal of FIG. 1.

As illustrated in FIGS. 5 and 6, the left side surface portion 9 and the right side surface portion 10 are provided opposite to each other, and bent at the sides along the longitudinal direction of the top surface portion 8 to extend vertically toward the substrate 3. The left side surface portion 9 has two leg portions 9*a*, 9*a* provided at the lower end. The right side surface portion 10 has two leg portions 10*a*, 10*a* provided at the lower end. The housing 4 is fixed to the substrate 3 by soldering the leg portions 9*a*, 10*a* to the substrate 3. In addition, a connection portion 9*b* is provided on the front side of the left side surface portion 9 to be coupled to the bottom surface portion 11.

Figure 8:
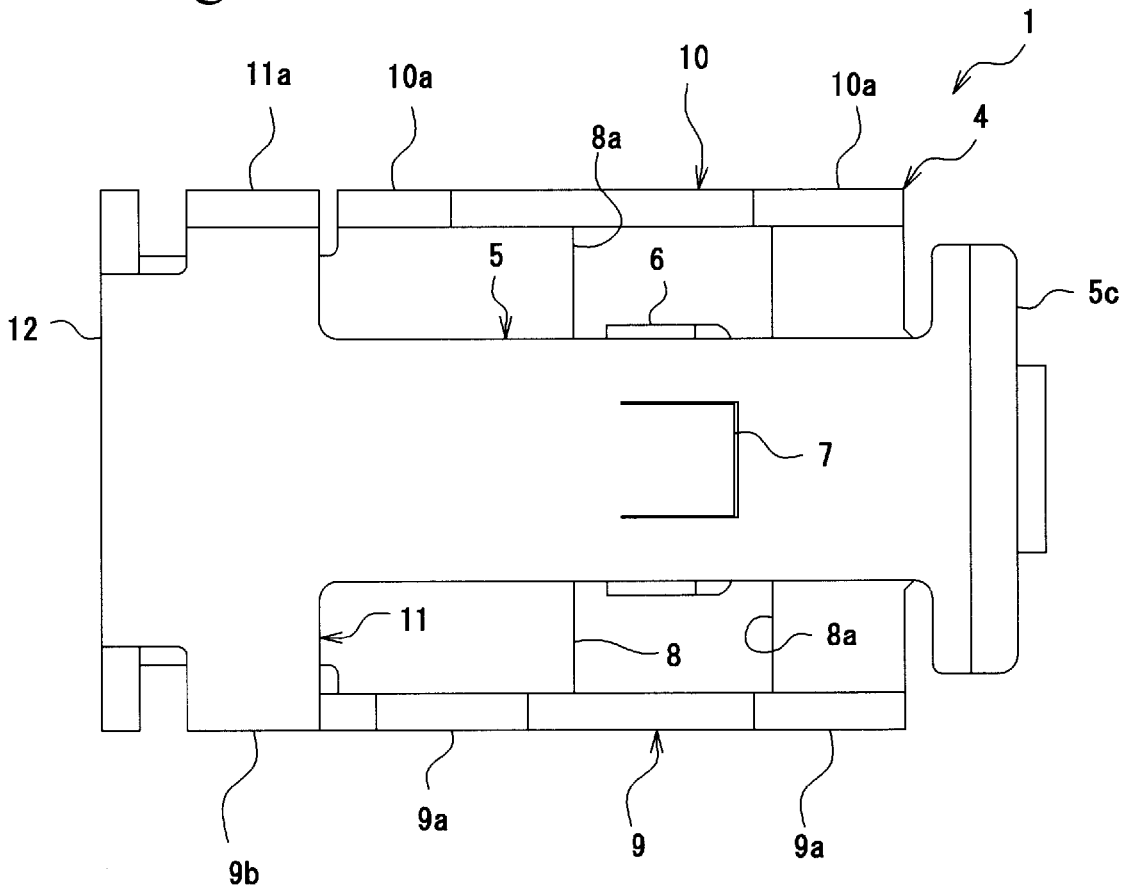
FIG. 8 is a bottom view of the linear conductor connection terminal of FIG. 1.

The bottom surface portion 11 is bent at a right angle at the connection portion 9*b* provided to the left side surface portion 9 to extend generally in parallel with the top surface portion 8. As illustrated in FIG. 8, a fixation portion 11*a* to be soldered to the substrate 3 is provided on the right side surface portion 10 side of the bottom surface portion 11. The bottom surface portion 11 is supported by the fixation portion 11*a* and the connection portion 9*b*. The front surface portion 12 is formed on the front side of the bottom surface portion 11, and bent to extend vertically toward the top surface portion 8. In addition, the lever 5 is provided at the rear end of the bottom surface portion 11 integrally with the bottom surface portion 11. The lever 5 extends in a cantilever manner toward the back side of the housing 4.

Figure 3:
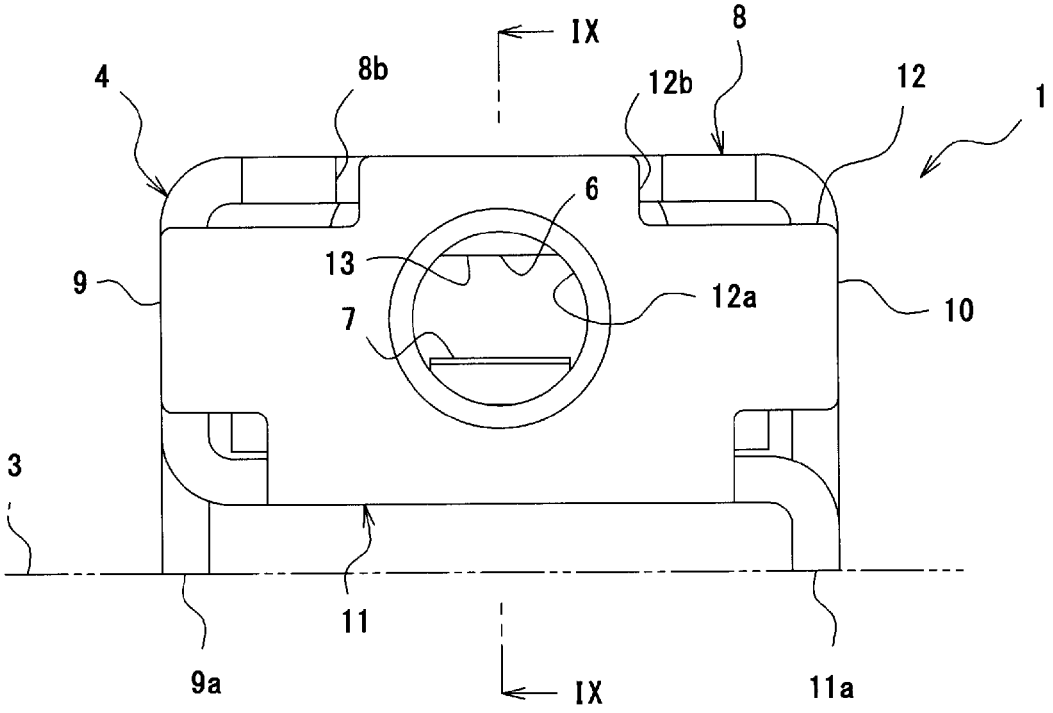
FIG. 3 is a front view of the linear conductor connection terminal of FIG. 1.
Figure 4:
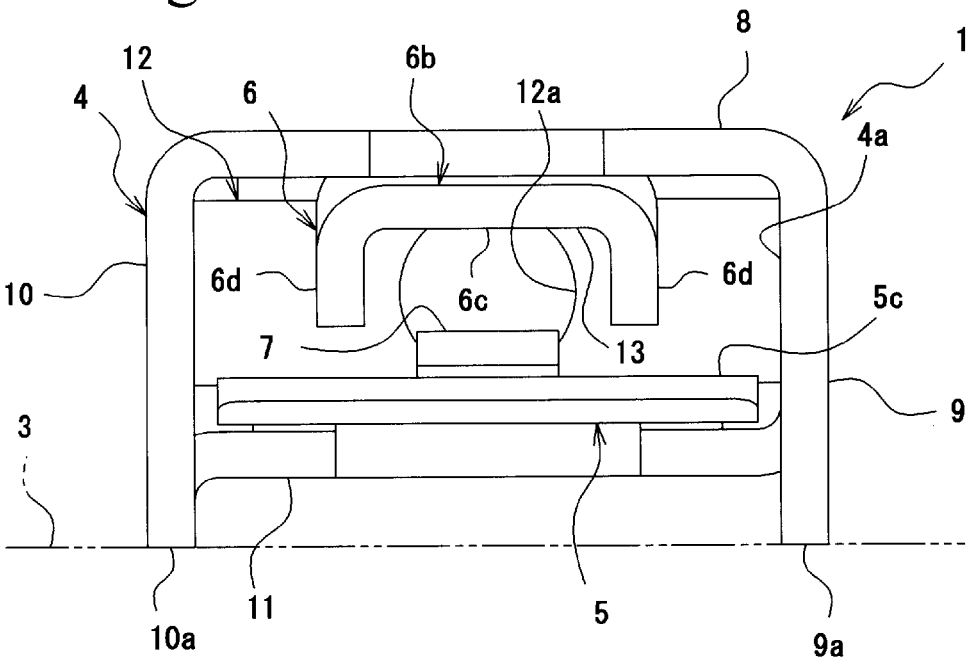
FIG. 4 is a back view of the linear conductor connection terminal of FIG. 1.

As illustrated in FIG. 3, the front surface portion 12 has a circular insertion port 12 for the linear conductor 2*a* provided generally at the center. A projecting portion 12*b* is provided at an end portion of the front surface portion 12 on the top surface portion 8 side. The projecting portion 12*b* is housed inside the recessed portion 8*b* of the top surface portion 8.

Figure 10:
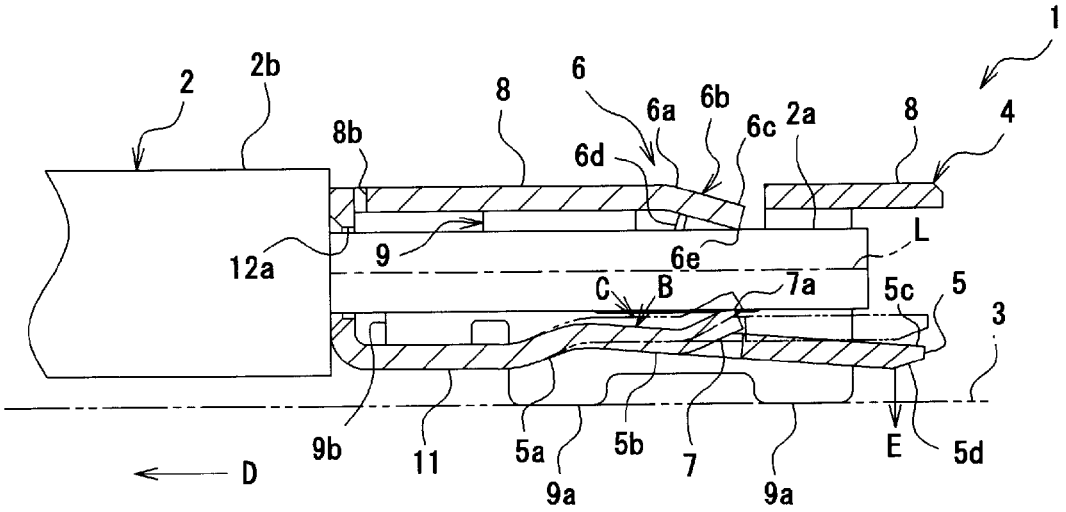
FIG. 10 illustrates a state in which a cable is connected to the linear conductor connection terminal of FIG. 1.

As illustrated in FIG. 10, in addition, the insertion port 12*a* is provided such that the top surface portion 8 is at the same height as or proximate in height to the upper end of the sheath 2*b* of the cable 2 with the linear conductor 2*a* inserted. This prevents the housing 4 mounted on the substrate 3 from projecting compared to other parts mounted on the substrate 3 to hinder mounting of the other parts. In contrast, the insertion port 12*a* is provided such that the bottom surface portion 11 is at the same height as or proximate in height to the lower end of the sheath 2*b* of the cable 2. This suppresses contact between the cable 2 and the substrate 3.

(Lever)

Figure 9:
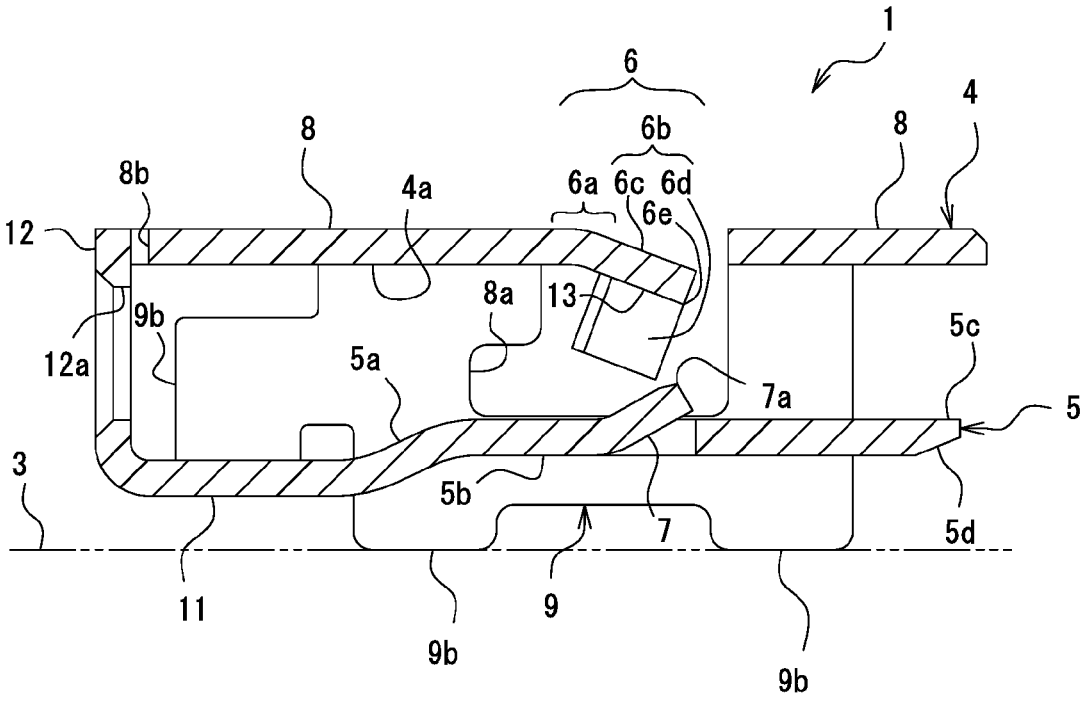
FIG. 9 is a sectional view of the linear conductor connection terminal taken along the line IX-IX of FIG. 3.

The lever 5 is a cantilever plate spring. As illustrated in FIG. 9, the lever 5 has a bent portion 5*a*, a displaceable portion 5*b*, and an operation portion 5*c*. The bent portion 5*a* is provided continuously with the bottom surface portion 11, and inclined toward the inside of the housing 4. The displaceable portion 5*b* is provided on the rear side of the bent portion 5*a* to extend generally in parallel with the top surface portion 8. In addition, the second contact point portion 7 is provided generally at the center of the displaceable portion 5*a*. The second contact point portion 7 is formed by cutting and raising a portion of the plate surface to extend toward the inside of the housing 4.

The bottom surface portion 11 provided in front of the lever 5 is supported away from the substrate 3 by the fixation portion 11*a* provided to the bottom surface portion 11 and the connection portion 9*b* which connects between the left side surface portion 9 and the bottom surface portion 11. This brings the lever 5 into a free state in which the lever 5 is displaceable inwardly and outwardly of the housing 4 about a portion of the lever 5 on the bottom surface portion 11 side, which allows the lever 5 to be elastically displaced by pressing the operation portion 5*c* toward the substrate 3. In addition, the operation portion 5*c* can have a width that is larger than the outside diameter of the linear conductor 2*a*. This makes it easy for an operator (not illustrated) to operate the operation portion 5*c* by touching a portion of the operation portion 5*c* that protrudes from both sides of the linear conductor 2*a* in the width direction even if the linear conductor 2*a* inserted into the housing space 4*a* of the housing 4 from the insertion port 12*a* overlaps the operation portion 5*c*. Further, the lever 5 extends along the insertion direction of the linear conductor 2*a* from the insertion port 12*a* side. Thus, the lever 5 can reliably have a length enough to be elastically displaced even if the lever 5 is so compact as not to project from the housing 4 in the width direction.

(First Contact Point Portion)

As illustrated in FIGS. 4 to 7 and 9, the first contact point portion 6 is provided as an elastic piece that is integral with the top surface portion 8 of the housing 4. The first contact point portion 6 has a coupling portion 6*a* connected to the top surface portion 8, and a recessed portion 6*b* provided at the distal end side of the coupling portion 6*a*. As illustrated in FIG. 9, a distance S is provided along the insertion direction of the linear conductor 2*a* between at least one of the first contact point portion 6 and the second contact point portion 7 and the insertion port 12*a*. This allows the linear conductor 2*a* to be held by at least one of the first contact point portion 6 and the second contact point portion 7 and the insertion port 12*a* provided at a position the distance S away therefrom. Hence, it is easy to keep the linear conductor 2*a* in parallel with the top surface portion 8 and the bottom surface portion 11 compared to a case where the linear conductor 2*a* is held at a plurality of positions that are proximate to each other along the insertion direction. Therefore, it is possible to suppress occurrence of damage to or deformation of the linear conductor 2*a* or the housing 4 due to contact of the linear conductor 2*a* with the top surface portion 8 or the bottom surface portion 11 from the inside of the housing 4, or application of a significantly large load to only the insertion port 12*a*, the first contact point portion 6, or the second contact point portion 7. The recessed portion 6*b* is formed by extending the coupling portion 6*a* and bending the distal end side toward the inside of the housing 4. In addition, the recessed portion 6*b* has a horizontal wall portion 6*c* connected to the coupling portion 6*a*, and vertical wall portions 6*d*, 6*d* provided at both side ends of the horizontal wall portion 6*c* and bent and projecting toward the inside of the housing 4. The number of parts can be reduced by bending the coupling portion 6*a* to provide the recessed portion 6*b* integrally with the coupling portion 6*a*. Similarly, the number of parts can be reduced by providing the first contact point portion 6 having the recessed portion 6*b* integrally with the housing 4.

The coupling portion 6*a* and the recessed portion 6*b* are inclined toward the inside of the housing 4 to the distal end side of the coupling portion 6*a* and the recessed portion 6*b*. The recessed portion 6*b* is disposed inside the housing space 4*a* of the housing 4. The coupling portion 6*a* has spring elasticity, and connects between the recessed portion 6*b* and the housing 4 in a cantilever manner so that the recessed portion 6*b* elastically contacts the linear conductor 2*a* inserted from the insertion port 12*a*. In addition, the corner portion of the horizontal wall portion 6*c* of the recessed portion 6*b* on the bottom surface portion 11 side serves as a contact point edge portion 6*e* to conductively connect with the linear conductor 2*a*.

(Second Contact Point Portion)

As illustrated in FIG. 9, the second contact point portion 7 is provided to be inclined toward the inside of the housing 4 from the base portion to the back side of the housing 4. When the lever 5 is operated to be displaced toward the substrate 3, the second contact point portion 7 is also elastically displaced in the same direction in conjunction with the lever 5. In addition, the second contact point portion 7 is formed as an elastic piece provided by cutting and raising a portion of the lever 5 around the center, and elastically contacts the linear conductor 2*a*. The corner portion of the second contact point portion 7 on the top surface portion 8 side serves as a contact point edge portion 7*a* to conductively connect with the linear conductor 2*a* inserted into the housing space 4*a* from the insertion port 12*a*. The contact point edge portion 7*a* of the second contact point portion 7 is provided opposite to the contact point edge portion 6*e* of the first contact point portion 6 along the vertical direction of the housing 4. Hence, the second contact point portion 7 holds the linear conductor 2*a* from both sides in the vertical direction of the linear conductor connection terminal 1 between the first contact point portion 6 and the second contact point portion 7. In addition, movement of the linear conductor 2*a* in directions other than the insertion direction can be suppressed with the linear conductor 2*a* inserted through an insertion passage 13 surrounded from all directions by the horizontal wall portion 6*c* and the vertical wall portions 6*d*, 6*d* of the recessed portion 6*b* and the second contact point portion 7. The number of parts can be reduced by forming the second contact point portion 7 integrally with the lever 5.

(Connection of Linear Conductor)

First, the linear conductor 2*a* is inserted into the insertion port 12*a*, and further advanced deep into the housing 4. As illustrated in FIGS. 3, 4, 9, and 10, the insertion passage 13 is provided on the extension of a center axis L of the linear conductor 2*a* which has passed through the insertion port 12*a*. In addition, as illustrated in FIG. 10, the first contact point portion 6 and the second contact point portion 7 are provided opposite to each other across the center axis L. The first contact point portion 6 and the second contact point portion 7 are formed to be inclined toward the center axis L from the side of the insertion port 12*a* for the linear conductor 2*a* toward the back side in the insertion direction. Hence, the gap between the first contact point portion 6 and the second contact point portion 7 becomes narrower along the insertion direction of the linear conductor 2*a*. Therefore, the insertion passage 13 is formed to be tapered toward the back side of the linear conductor 2*a*. Thus, the gap between the contact point edge portion 6*e* of the first contact point portion 6 and the contact point edge portion 7*a* of the second contact point portion 7 is smaller than the outside diameter of the linear conductor 2*a*. Hence, the distal end of the linear conductor 2*a* contacts the horizontal wall portion 6*c* of the recessed portion 6*b* or the second contact point portion 7 in the course of time. The horizontal wall portion 6*c* is inclined from the top surface portion 8 side toward the bottom surface portion 11. The second contact point portion 7 is inclined from the bottom surface portion 11 side toward the top surface portion 8. Therefore, the linear conductor 2*a* which has contacted the horizontal wall portion 6*c* or the second contact point portion 7 is guided to the recessed portion 6*b* along the inclination of the horizontal wall portion 6*c* or the second contact point portion 7. Then, the linear conductor 2*a* is inserted through the recessed portion 6*b* to be guided to the back side of the housing 4. The linear conductor 2*a* can be guided to the back side of the housing 4 with the two vertical wall portions 6*d*, 6*d* of the recessed portion 6*b* regulating movement of the linear conductor 2*a* in the width direction even if the linear conductor 2*a* is inserted obliquely so that the insertion direction deviates in the width direction of the housing 4, or the distal end of the linear conductor 2*a* is bent so that it is difficult to insert the linear conductor 2*a* straight to the back side of the housing 4.

The length of the horizontal wall portion 6*c* in the width direction is set to be larger than the outside diameter of the linear conductor 2*a*, which facilitates insertion of the linear conductor 2*a* between the vertical wall portions 6*d*, 6*d* to contact the horizontal wall portion 6*c*.

As described above, the gap between the contact point edge portion 6*e* of the first contact point portion 6 and the contact point edge portion 7*a* of the second contact point portion 7 is smaller than the outside diameter of the linear conductor 2*a*. The coupling portion 6*a* of the first contact point portion 6 and the second contact point portion 7 has spring elasticity, and can be elastically displaced when pushed by the distal end of the linear conductor 2*a*. In addition, the second contact point portion 7 is provided integrally with the lever 5. Therefore, the bent portion 5*a* of the lever 5 can be elastically displaced toward the substrate 3 when the distal end portion of the linear conductor 2*a* presses the second contact point portion 7 (see FIG. 10). This allows the second contact point portion 7 to be displaced toward the substrate 3 from the position indicated by the arrow C to the position indicated by the arrow B in conjunction with the lever 5, which widens the gap between the contact point edge portion 6*e* of the first contact point portion 6 and the contact point edge portion 7*a* of the second contact point portion 7 to allow insertion of the linear conductor 2*a*.

As discussed earlier, the lever 5 is held in a free state in which the lever 5 is displaceable inwardly and outwardly of the housing 4 about a portion of the lever 5 on the bottom surface portion 11 side. As illustrated in FIG. 9, the lever 5 is formed to have generally the same length as that of the top surface portion 8 of the housing 4 in the insertion direction of the linear conductor 2*a*. In contrast, the second contact point portion 7 is formed by cutting and raising a portion of the lever 5, and shorter than the lever 5. Therefore, the second contact point portion 7 is harder and more difficult to deform and elastically displace than the lever 5. Hence, even if the second contact point portion 7 is pressed by the linear conductor 2*a* to be elastically displaced, the second contact point portion 7 is restored to the original shape with a strong force. Therefore, the contact point edge portion 7*a* can be strongly engaged with the linear conductor 2*a*.

The insertion port 12*a* is formed along the outer peripheral surface of the linear conductor 2*a*, and formed with such a size that allows insertion of the linear conductor 2*a* but that resists insertion of the sheath 2*b*. As the linear conductor 2*a* is inserted deeper into the housing 4, an end surface of the sheath 2*b* abuts with the surrounding portion of the insertion port 12*a*, which stops insertion of the linear conductor 2*a* into the housing 4. Hence, the sheath 2*b* is prevented from being inserted into the housing 4 to contact the first contact point portion 6 and the second contact point portion 7, and the linear conductor 2*a* can be reliably conductively connected to the first contact point portion 6 and the second contact point portion 7.

The linear conductor 2*a* is held between the contact point edge portion 6*e* of the first contact point portion 6 and the contact point edge portion 7*a* of the second contact point portion 7 while staying inside the recessed portion 6*b*. As discussed above, the second contact point portion 7 is formed by cutting and raising a portion of the plate surface of the lever 5, and the second contact point portion 7 and the lever 5 are an elastic piece in the shape of a plate spring. Thus, when the linear conductor 2*a* presses the second contact point portion 7, a reaction force against the linear conductor 2*a* is generated in both the second contact point portion 7 and the lever 5. This allows the second contact point portion 7 to strongly push the linear conductor 2*a* against the first contact point portion 6 to hold the linear conductor 2*a*. The first contact point portion 6 has the recessed portion 6*b* having the horizontal wall portion 6*c* and the two vertical wall portions 6*d*, 6*d*. Therefore, movement of the linear conductor 2*a* outwardly of the housing 4 can be regulated by the recessed portion 6*b*, which makes it difficult for the linear conductor 2*a* to move away from the first contact point portion 6. In addition, the second contact point portion 7 contacts the linear conductor 2*a* from the opening side of the recessed portion 6*b*, which allows the linear conductor 2*a* to reliably conductively connect with the first contact point portion 6 and the second contact point portion 7. In this event, the contact point edge portions 6*e*, 7*a* are engaged with the linear conductor 2*a* to contact the linear conductor 2*a*, which enhances the force for holding the linear conductor 2*a*. Hence, the cable 2 can be prevented from being extracted easily with the contact point edge portions 6*e*, 7*a* retaining the linear conductor 2*a* even if the cable 2 is pulled in the extraction direction (the direction indicated by the arrow D in FIG. 10), and conductive connection with the linear conductor 2*a* can be maintained easily.

Consequently, the linear conductor 2*a* is held between the first contact point portion 6 and the second contact point portion 7. In this event, the linear conductor 2*a* is also supported at the lower end of the insertion port 12*a*. Thus, the load of the cable 2 including the sheath 2*b* is applied to the front surface portion 12 in which the insertion port 12*a* is provided. The housing 4 is provided with the leg portions 9*a*, 10*a* soldered to the substrate 3. However, concentration of a stress on the leg portions 9*a*, 10*a* is suppressed by providing the fixation portion 11*a* at a position in proximity to the front surface portion 12 so that the fixation portion 11*a* supports the load of the cable 2.

(Extraction of Linear Conductor)

Figure 11:
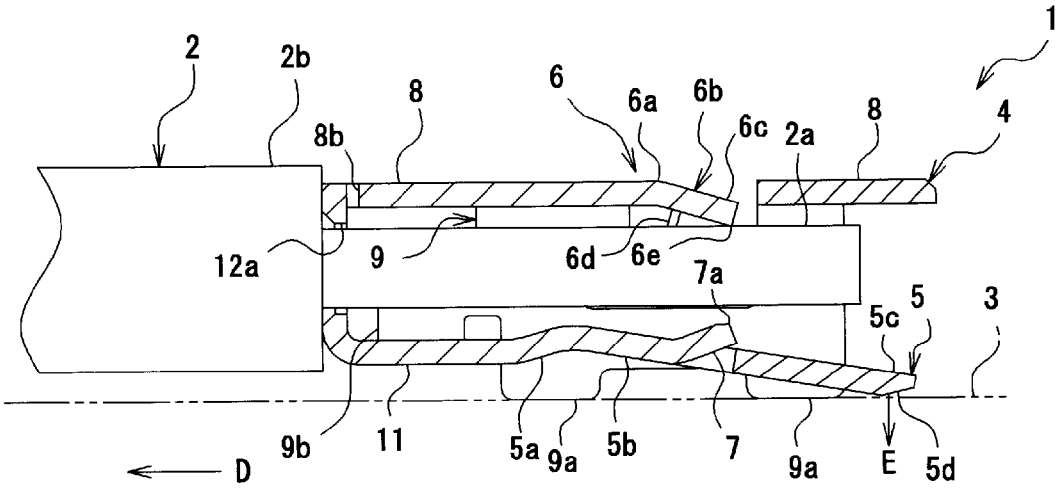
FIG. 11 illustrates a state in which a lever of the linear conductor connection terminal of FIG. 10 is pressed.

When the lever 5 is pressed toward the substrate 3 (in the direction indicated by the arrow E) as illustrated in FIG. 11 with the linear conductor 2 a contacting the first contact point portion 6 and the second contact point portion 7, the bent portion 5*a* is elastically displaced toward the substrate 3. Then, the second contact point portion 7 provided to the lever 5 is also displaced toward the substrate 3 in the direction away from the linear conductor 2*a*. This allows the linear conductor 2*a* to be pulled out in the extraction direction (the direction indicated by the arrow D in FIG. 11) with the contact point edge portion 7*a* of the second contact point portion 7 disengaged from the linear conductor 2*a*.

In addition, an inclined portion 5*d* inclined in the direction away from the substrate 3 toward the rear is formed on a surface of the operation portion 5*c* on the substrate 3 side (see FIG. 11). This makes it difficult for the operation portion 5*c* to contact the substrate 3 when the operation portion 5*c* is pressed toward the substrate 3 (in the direction indicated by the arrow E). Hence, the operation portion 5*c* can be pushed down sufficiently until the linear conductor 2*a* is successfully extracted.

(Function and Effect of Linear Conductor Connection Terminal According to Embodiment)

With the linear conductor connection terminal 1 according to the embodiment, as described above, the cable 2 can reliably reach the first contact point portion 6 and the second contact point portion 7 by providing the recessed portion 6*b* and inserting the linear conductor 2*a* through the recessed portion 6*b*. In addition, conductive connection with the linear conductor 2*a* can be maintained easily by holding the linear conductor 2*a* between the first contact point portion 6 and the second contact point portion 7.

Modifications of Embodiment

In the linear conductor connection terminal 1 described above, the first contact point portion 6 having the recessed portion 6*b* is provided to the top surface portion 8, and the second contact point portion 7 is provided by cutting and raising a portion of the lever 5. Conversely, however, the second contact point portion 7 may be provided to the top surface portion 8, and the first contact point portion 6 having the recessed portion 6*b* may be provided by cutting and raising a portion of the lever 5. In addition, the first contact point portion 6 having the recessed portion 6*b* may be provided to both the top surface portion 8 and the lever 5. This allows the linear conductor 2*a* to be held between the two first contact point portions 6 so as to reliably maintain conductive connection between the linear conductor 2*a* and the linear conductor connection terminal 1.

In the linear conductor connection terminal 1, in addition, the recessed portion 6*b* has two vertical wall portions 6*d*. On the contrary, the recessed portion 6*b* may have only one vertical wall portion 6*d*. In this case, the linear conductor 2*a* inserted into the housing space 4*a* of the housing 4 is guided to the back side by the vertical wall portion 6*d*, the horizontal wall portion 6*c*, and an inner surface of the left side surface portion 9 or the right side surface portion 10 of the housing 4. If the inner side of the left side surface portion 9 or the right side surface portion 10 is used in place of the vertical wall portion 6*d*, the amount of the conductive metal plate used for the linear conductor connection terminal 1 can be reduced.

In the linear conductor connection terminal 1, the lever 5, the first contact point portion 6, and the second contact point portion 7 are provided integrally with the housing 4. However, any of such parts may be provided as separated parts to be incorporated into the housing 4. This allows any of the parts to be replaced in the case where a design change is required for the part or in the case where a partial modification is implemented to accommodate various diameters of the cable 2, for example.

What is claimed is:

1. A linear conductor connection terminal comprising a housing having an insertion port for a linear conductor and fixed to a substrate, wherein the housing has a top surface and a bottom surface extending in parallel with a substrate, a first contact point portion having a recessed portion composed of a metal plate and opening inwardly of the housing, the first contact point portion allowing insertion, and a second contact point portion that contacts the linear conductor inserted from the insertion port configured to support contact between the linear conductor and the first contact point portion, wherein the recessed portion has a first wall continuously and inwardly extending from the top surface of the housing toward an inside of the housing, and a second wall extending perpendicularly and inwardly of the housing from both side ends of the first wall, the first wall and each second wall configured to guide the linear conductor inserted from the insertion port to a back side inside the housing so as to secure the contact between the linear conductor and the first contact point portion.

2. The linear conductor connection terminal according to claim 1, wherein the first contact point portion is formed by bending a part of the metal plate forming the housing into a recessed shape.

3. The linear conductor connection terminal according to claim 1, wherein the first contact point portion and the second contact point portion are formed as a part of the metal plate forming the top surface of the housing and a part of the metal plate forming the bottom surface of the housing.

4. The linear conductor connection terminal according to claim 1, wherein the first contact point portion has a coupling portion that has spring elasticity and that connects between the recessed portion and the housing in a cantilever manner along the insertion direction, and the coupling portion is formed as a part of the metal plate that is integral with the housing and the recessed portion.

5. The linear conductor connection terminal according to claim 1, wherein the first contact point portion is formed on one surface of the housing, and formed to be inclined toward an inside of the housing from one end side, from which the linear conductor is inserted, to the other end.

6. The linear conductor connection terminal according to claim 1, wherein the first contact point portion and the second contact point portion are provided opposite to each other across a center axis of the linear conductor inserted into the housing, and formed to be inclined closer to the center axis from a side from which the linear conductor is inserted.

7. The linear conductor connection terminal according to claim 1, wherein the first contact point portion and the second contact point portion are each formed as an elastic piece that abuts with the linear conductor inserted into the housing to be elastically displaced.

8. The linear conductor connection terminal according to claim 1, wherein the linear conductor has an electrically insulating sheath, and the insertion port is formed with such a size that allows insertion of the linear conductor but that does not allow insertion of the sheath.

9. The linear conductor connection terminal according to claim 1, the top surface is at the same height as or proximate in height to an upper end of the sheath of the linear conductor, and the bottom surface is at the same height as or proximate in height to a lower end of the sheath.

10. A linear conductor connection terminal according to claim 1, the first wall, each second wall, and the second contact point portion guides the linear conductor inside the housing from the insertion port towards a back side of the housing by four directions configured to secure the contact between the linear conductor and the first and second contact point portions.

11. A linear conductor connection terminal according to claim 1, the first wall further having a contact point edge located at a terminal end edge closest inwardly configured to contact the linear conductor.

12. The linear conductor connection terminal according to claim 1, wherein the first contact point portion has a contact point edge formed by a corner portion of the metal plate that contacts the linear conductor, the second contact point portion has a contact point edge formed by a corner portion of a metal plate that contacts the linear conductor, and the contact point edge of the first contact point portion and the contact point edge of the second contact point portion are engaged with the linear conductor to contact the linear conductor.

13. The linear conductor connection terminal according to claim 12, wherein the contact point edge of the first contact point portion and the contact point edge of the second contact point portion are disposed opposite to each other to hold the linear conductor therebetween.

14. The linear conductor connection terminal according to claim 1, wherein the housing includes a lever that displaces at least one of the first contact point portion and the second contact point portion in a direction away from the linear conductor.

15. The linear conductor connection terminal according to claim 14, wherein the lever is formed by bending a part of the metal plate forming the housing.

16. The linear conductor connection terminal according to claim 14, wherein the lever has an operation portion with a width that is larger than an outside diameter of the linear conductor inserted into the housing.

17. The linear conductor connection terminal according to claim 14, wherein at least one of the first contact point portion and the second contact point portion is formed as an elastic piece by cutting and raising a part of the metal plate forming the lever.

18. The linear conductor connection terminal according to claim 14, wherein the linear conductor has an electrically insulating sheath, and the insertion port is formed with such a size that allows insertion of the linear conductor but that does not allow insertion of the sheath.

19. The linear conductor connection terminal according to claim 14, the top surface is at the same height as or proximate in height to an upper end of the sheath of the linear conductor, and the bottom surface is at the same height as or proximate in height to a lower end of the sheath.

* * * * *